US006666933B2

(12) United States Patent
Roberts et al.

(10) Patent No.: US 6,666,933 B2
(45) Date of Patent: Dec. 23, 2003

(54) CAN END, AND METHOD OF MANUFACTURE THEREFOR

(75) Inventors: David Andrew Roberts, Wokingham (GB); Andrew Osborne Blow, Grove (GB); John Alfred Perigo, Witney (GB)

(73) Assignee: Crown Cork & Seal Technologies Corporation, Alsip, IL (US)

( * ) Notice: Subject to any disclaimer, the term of this patent is extended or adjusted under 35 U.S.C. 154(b) by 0 days.

(21) Appl. No.: 09/862,293

(22) Filed: May 22, 2001

(65) Prior Publication Data

US 2002/0046786 A1 Apr. 25, 2002

Related U.S. Application Data

(63) Continuation-in-part of application No. 09/403,110, filed as application No. PCT/GB98/01073 on Apr. 14, 1998, now abandoned, and a continuation-in-part of application No. 09/403,209, filed as application No. PCT/GB98/01072 on Apr. 14, 1998, now abandoned.

(30) Foreign Application Priority Data

Apr. 16, 1997 (GB) ..... 9707678
Apr. 16, 1997 (GB) ..... 9707688

(51) Int. Cl.[7] ..... C22F 1/04; B21D 51/38; B65B 7/28

(52) U.S. Cl. ..... 148/691; 148/692; 148/693; 53/487

(58) Field of Search ..... 53/487, 296; 148/437, 148/438, 439, 440, 691, 692, 693

(56) References Cited

U.S. PATENT DOCUMENTS

| | | | | |
|---|---|---|---|---|
| 3,704,140 A | 11/1972 | Petit et al. | ..... | 99/214 |
| 4,109,599 A | 8/1978 | Schultz | ..... | 113/121 C |
| 4,458,469 A | 7/1984 | Dunn | ..... | 53/487 |
| 4,564,119 A | 1/1986 | Tsuge et al. | ..... | 220/270 |
| 4,571,978 A | 2/1986 | Taube et al. | ..... | 72/349 |
| 4,680,917 A | 7/1987 | Hambleton et al. | ..... | 53/487 |
| 4,836,398 A | 6/1989 | Leftault, Jr. et al. | ..... | 220/66 |
| 4,967,538 A | 11/1990 | Leftault, Jr. et al. | ..... | 53/440 |
| 5,240,522 A | 8/1993 | Tanaka et al. | ..... | 148/693 |

FOREIGN PATENT DOCUMENTS

| | | |
|---|---|---|
| EP | 0 521 642 A1 | 1/1993 |
| EP | 0 398 529 B1 | 10/1995 |
| FR | 2 574 761 | 6/1986 |
| GB | 1 376 514 | 12/1974 |
| GB | 1 540 229 | 2/1979 |
| GB | 2 042 373 | 9/1980 |
| GB | 2 168 313 | 6/1986 |
| GB | 2 259 075 | 3/1993 |
| WO | WO 93/17864 | 9/1993 |
| WO | WO 98/46383 | 10/1998 |
| WO | WO 98/46488 | 10/1998 |

*Primary Examiner*—Sikyin Ip
(74) *Attorney, Agent, or Firm*—Woodcock Washburn, LLP

(57) ABSTRACT

A can end is manufactured by forming an end shell comprising a radially outer seaming flange, a chuck wall adjacent the seaming flange, a center panel, and an axially downward countersink joining the center panel to the chuck wall below the level of the seaming flange. The end shell is converted to an easy-open can end by forming a score on a portion of the center panel, raising a rivet on the center pane, and forming a tab and attaching the tab to the rivet. The end is subsequently formed by moving the center panel and the seaming flange one with respect to the other to raise the center panel above the level of the seaming flange.

20 Claims, 5 Drawing Sheets

| | |
|---|---|
| Manganese | 0.10 max |
| Magnesium | 2.2-2.8 |
| Silicon | 0.25 max |
| Iron | 0.40 max |
| Copper | 0.10 max |
| Chromium | 0.15-0.35 |
| Zinc | 0.10 max |
| Others | 0.05 max |
| Others Total | 0.15 max |
| Aluminium | remainder |

FIGURE 6

| Alloy | Temper or equivalent | Alternative Temper | Proof Strength N/mm² | Gauge |
|---|---|---|---|---|
| 5052 | H44 coil lacquered | H24 sheet lacquered | 250 max | 0.22mm or less |
| 5352 | H44 coil lacquered | H24 sheet lacquered | 250 max | 0.22mm or less |
| 5042 | H44/H42 coil lacquered | H24/H22 sheet lacquered | 250 max | 0.22mm or less |
| 5154 | H44/H42 coil lacquered | H24/H22 sheet lacquered | 250 max | 0.22mm or less |
| 5182 | H42 coil lacquered | H22 sheet lacquered | 250 max | 0.22m or less |
| 5082 | H42 coil lacquered | H22 sheet lacquered | 250 max | 0.22 or less |
| | | | | |
| 3004 | H24/H26 laminated | | 250 max | 0.22mm or less |
| 3104 | H24/H26 laminated | | 250 max | 0.22mm or less |
| 3105 | H19/H18 laminated | | 250 max | 0.22mm or less |
| | | | | |
| | Euronorm Designation or equivalent | | | |

FIGURE 7

CAN END, AND METHOD OF MANUFACTURE THEREFOR

This application is a continuation in part of prior application Ser. No. 09/403,110, filed Oct. 14, 1999 now abandoned, which is a national phase filing of PCT/GB98/01073, filed Apr. 14, 1998 and claiming priority to Great Britain application serial number 9707688.9, filed Apr. 16, 1997; and prior application Ser. No. 09/403,209, filed Oct. 14, 1999 now abandoned, which is a national phase filing of PCT/GB98/01072, filed Apr. 14, 1998 and claiming priority to Great Britain application serial number 9707678.0, filed Apr. 16, 1997.

FIELD OF THE INVENTION

This invention relates to can ends, and particularly to ends for cans filled with food or non-carbonated beverages.

BACKGROUND OF THE INVENTION

In cans for carbonated beverages the internal pressure generated by the carbon dioxide content of the product contributes significant strength to the very thin sidewalls of the cans. In contrast, non-carbonated products are frequently hot filled into cans and when such cans are cooled an internal vacuum is developed. This dictates that the can walls should be relatively thick to withstand the vacuum without collapsing or panelling. Much effort has been devoted to methods intended to ensure that the pressure in the headspace of the can containing a non-carbonated product is maintained at a pressure significantly above atmospheric throughout its storage life, thereby facilitating the use of lightweight DWI cans for such products. Mechanical pressurisation processes have been proposed in U.S. Pat. No. 4,836,398 and EP 0521642A. In these proposals, the can is provided with at least one deformable wall element, generally in the top or bottom end of the can, which is deformed after filling and seaming to reduce the internal volume of the can and thus to increase the internal pressure. The present invention seeks to provide a deformable can end of this type, as well as an efficient and reliable manufacturing process for such a can end.

SUMMARY OF THE INVENTION

Accordingly, a presently-preferred method of manufacturing a can end comprises forming an end shell comprising a radially outer seaming flange, a chuck wall adjacent the seaming flange, a center panel, and an axially downward countersink joining the center panel to the chuck wall below the level of the seaming flange. The method also comprises converting the shell to an easy-open can end by forming a score on a portion of the center panel, raising a rivet on the center panel, forming a tab and attaching the tab to the rivet, and subsequently forming the end by moving the center panel and the seaming flange one with respect to the other to raise the center panel above the level of the seaming flange.

Another presently-preferred method of manufacturing a can end comprises forming an end shell comprising a radially outer seaming flange, a chuck wall adjacent the seaming flange, a center panel, and an axially downward countersink joining the center panel to the chuck wall below the level of the seaming flange. The method also comprises converting the shell to an easy-open can end by forming a score on a portion of the center panel, raising a rivet on the center panel, and forming a tab and attaching the tab to the rivet. The method further comprises subsequently forming the end by moving the center panel and the seaming flange one with respect to the other to raise the center panel above the level of the seaming flange, and securing the end to a can body which has been filled with product. The method also comprises performing a second reforming operation on the can end to move the center panel and the seaming flange one with respect to the other to lower the center panel to a height below the level of the seaming flange, thereby reducing the headspace within the package.

Another presently-preferred method of manufacturing a can end comprises forming an end shell comprising a radially outer seaming flange, a chuck wall adjacent the seaming flange, a center panel, and an axially downward countersink joining the center panel to the chuck wall below the level of the seaming flange. The method also comprises supporting the end shell on a carrier belt, and moving the carrier belt to transport the end shell to a conversion station, where the shell is converted to an easy-open end by forming a score on a portion of the center panel, raising a rivet on the center panel, and forming a tab and attaching the tab to the rivet. The method further comprises moving the carrier belt to transport the converted end to a reform station, where the end is reformed by moving the center panel and the seaming flange one with respect to the other to raise the center panel above the level of the seaming flange.

Another presently-preferred method of manufacturing a can end comprises forming an end shell from an aluminum alloy material having a thickness of approximately 0.22 mm or less and a proof strength of approximately 250 N/mm$^2$ or less so that the end shell comprises a radially outer seaming flange, a chuck wall adjacent the seaming flange, a center panel, and an axially downward countersink joining the center panel to the chuck wall below the level of the seaming flange. The method also comprises converting the shell to an easy-open can end by forming a score on a portion of the center panel, raising a rivet on the center panel, and forming a tab and attaching the tab to the rivet. The method further comprises subsequently forming the end by moving the center panel and the seaming flange one with respect to the other to raise the center panel above the level of the seaming flange.

The invention also provides an easy-open can end formed from one of a 3000 series aluminum alloy, a 5000 series aluminum alloy, and an 8000 series aluminum alloy, the end being formed from a material having a thickness of approximately 0.22 mm or less and a proof strength of approximately 225 N/mm$^2$ or less.

BRIEF DESCRIPTION OF THE DRAWINGS

The foregoing summary, as well as the following detailed description of a presently-preferred embodiment, is better understood when read in conjunction with the appended drawings. For the purpose of illustrating the invention, the drawings show an embodiment that is presently preferred. The invention is not limited, however, to the specific instrumentalities disclosed in the drawings. In the drawings:

FIG. 6 is a table listing the constituent elements of a 5052 aluminium alloy from which the can end shown in FIGS. 3–5 can be manufactured; and FIG. 7 is a table listing various aluminium alloys which can used to manufacture the can end shown in FIGS. 3–5.

DESCRIPTION OF PREFERRED EMBODIMENTS

Figure 1:
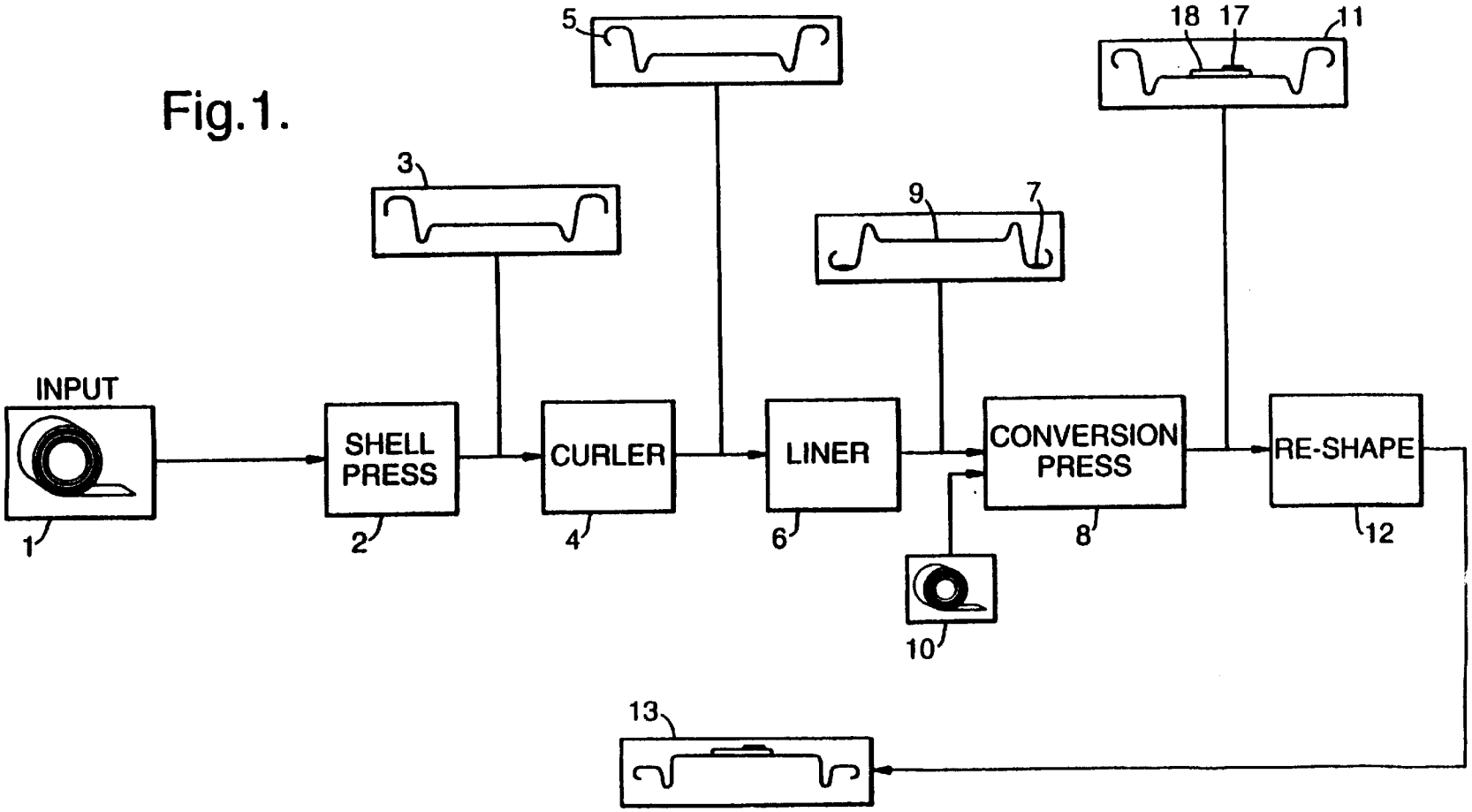
FIG. 1 is a schematic process diagram showing the stages in the manufacture of can ends according to the method of the present invention.

Referring to FIG. 1, a process for the manufacture of can ends is shown in schematic form. A coil 1 of pre-lacquered and lubricated aluminium alloy is fed to a shell press 2 which stamps out blanks and forms them into a shell shown generally at 3. There are a variety of techniques for forming these end shells, and examples are given in, e.g., U.S. Pat. Nos. 4,571,978 and 4,109,599, and EP 0398529B. The end shell 2 is then fed on a carrier belt to a curler 4 which curls over the edges of the shell to form a seaming flange shown at 5. The curled shells 4 are then fed into a liner 6 where they are inverted, and spun, and compound is injected onto the underside of the seaming flange as shown at 7. One example of a lining machine is given in GB 2042373.

The lined end shells are then fed on the carrier belt to a conversion press, shown generally at 8. A rivet 14 is raised on the center panel 9 of the shell, and a score is applied to the center panel to define a portion operable to produce an opening therein. More aluminium end stock 10 is used to produce a tab 15 which is staked to the end shell via the rivet on the center panel. The resulting can end is shown generally at 11.

The can ends 11 are then fed on the carrier belt to a reshaping station 12, where the center panel 9 is pushed upwardly to form the completed can end shown at 13.

Figure 2A:
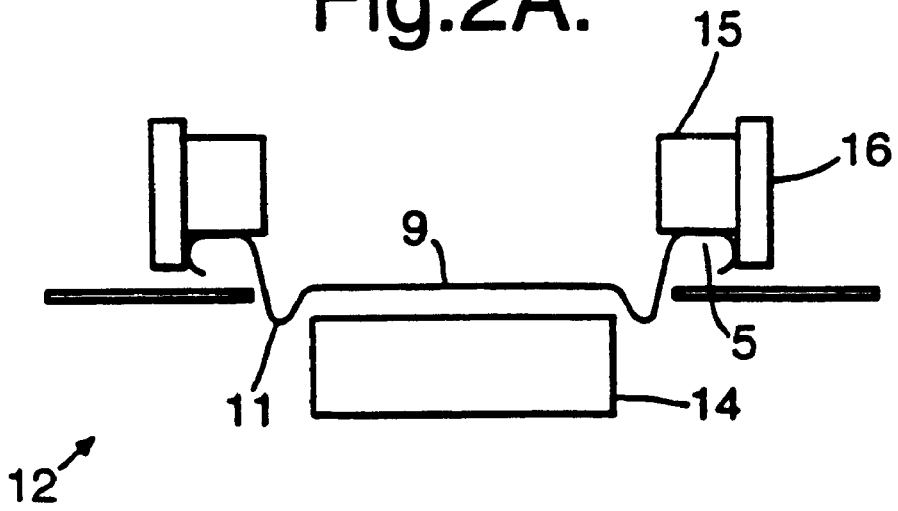
FIG. 2A is a schematic sectional view of tooling for the reshaping of can ends according to the method of FIG. 1, and a can end before being reformed using the tooling in accordance with the method of FIG. 1.
Figure 2B:
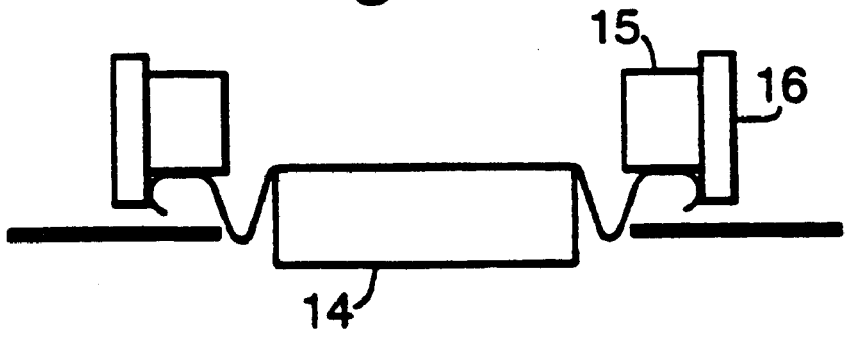
FIG. 2B is a schematic sectional view of the tooling and the can end shown in FIG. 2A, after the can end has been reformed using the tooling in accordance with the method of FIG. 1.

FIG. 2A shows the can end 11 (shown minus its tab 15 for the sake of clarity) at the reshaping station 12. The center panel 9 of the can end is pushed upwardly by a punch 14, the seaming flange 5 of the end being supported by a seaming panel support ring 15 and curl support ring 16 respectively. Once the end has been reshaped as shown in FIG. 2B, the punch 14 is retracted, and the can end exits the reshaping station 12 on the carrier belt.

Figure 3:
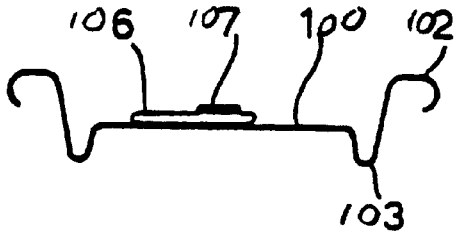
FIG. 3 is a schematic sectional view of an easy-open can end in accordance with the present invention, before being reformed in accordance with the method of FIG. 1.
Figure 4:
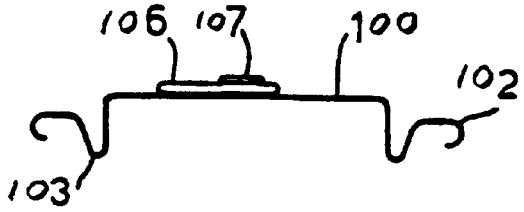
FIG. 4 is a schematic sectional view of an easy-open can end in accordance with the present invention, after being reformed in accordance with the method of FIG. 1.
Figure 5:
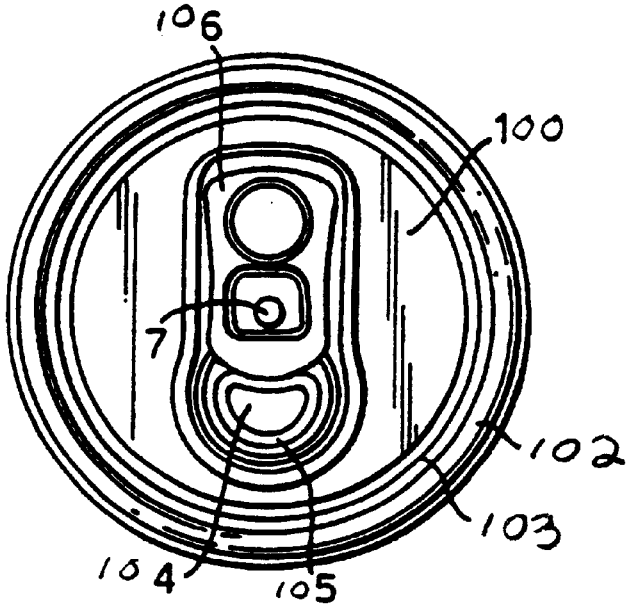
FIG. 5 is a plan view of the can end of FIGS. 3 and 4.

FIGS. 3 through 5 depict an easy-open can end that can be manufactured in accordance with the above-described method. The easy-open can end shown in FIGS. 3 through 5 is formed of 5052 aluminium alloy which has the following composition;

The 5052 alloy, the constituent elements of which are listed in tabular form in FIG. 6, is subjected to a heat treatment to provide it with an H44 temper (Euronorm Designation or equivalent), which produces an alloy with a proof strength of between 190–220 N/mm$^2$, typically 205 N/mm$^2$.

The 5052 alloy is manufactured into an easy can end including a central panel 100, seaming flange 102 and annular countersink 103 (see FIGS. 3 through 5). The can end is a stay on tab type can end, with an operable portion 104 surrounded by a score 105, and having the tab 106 attached the center panel by means of a raised rivet 107.

The can end, being of less than 0.22 mm in thickness, and manufactured from a relatively soft alloy having a proof strength of less than 250 N/mm$^2$, is able to withstand the reshaping of the center panel 100 between the positions as shown in FIGS. 3 and 4. The can end is first manufactured as shown in FIG. 3, reshaped as shown in FIG. 4, and then, once the end has been secured onto a container body, the center panel 100 is depressed back into the position previously shown in FIG. 3. This reduces the headspace in the container, and helps to reduce or eliminate any vacuum, caused by the cooling of hot filled products within the can.

Other aluminium alloys which can used to manufacture can ends according to the present invention are listed in tabular form in FIG. 7, together with the appropriate temper treatment as recognised by the Euronorm Designation system, or equivalent. The 5000 series alloys may be either coil lacquered or sheet lacquered. The 3000 series are included as being suitable for polymer lamination, as opposed to PVC lacquered coatings.

It will be appreciated that equivalents or derivatives of the alloys mentioned herein may also be employed without departing from the scope of the present invention. In particular, different manufacturers of aluminium alloys may have broadly similar alloys which they refer to using different designations, and those skilled in this field will be aware of such equivalent alloys.

What is claimed is:

1. A method of manufacturing a can end, comprising:

i) forming an end shell comprising a radially outer seaming flange, a chuck wall adjacent the seaming flange, a center panel, and an axially downward countersink joining the center panel to the chuck wall below the level of the seaming flange;

ii) converting the shell to an easy-open can end by:

a) forming a score on a portion of the center panel;

b) raising a rivet on the center panel; and c) forming a tab and attaching the tab to the rivet; and iii) subsequently forming the end by moving the center panel and the seaming flange one with respect to the other to raise the center panel above the level of the seaming flange.

2. A method of manufacturing a can end, comprising:

i) forming an end shell comprising a radially outer seaming flange, a chuck wall adjacent the seaming flange, a center panel, and an axially downward countersink joining the center panel to the chuck wall below the level of the seaming flange;

ii) converting the shell to an easy-open can end by:

a) forming a score on a portion of the center panel;

b) raising a rivet on the center panel; and c) forming a tab and attaching the tab to the rivet;

iii) subsequently forming the end by moving the center panel and the seaming flange one with respect to the other to raise the center panel above the level of the seaming flange;

iv) securing the end to a can body which has been filled with product; and v) performing a second reforming operation on the can end to move the center panel and the seaming flange one with respect to the other to lower the center panel to a height below the level of the seaming flange, thereby reducing the headspace within the package.

3. A method of manufacturing a can end, comprising:

i) forming an end shell comprising a radially outer seaming flange, a chuck wall adjacent the seaming flange, a center panel, and an axially downward countersink joining the center panel to the chuck wall below the level of the seaming flange;

ii) supporting the end shell on a carrier belt;

iii) moving the carrier belt to transport the end shell to a conversion station, where the shell is converted to an easy-open end by:

a) forming a score on a portion of the center panel;

b) raising a rivet on the center panel; and c) forming a tab and attaching the tab to the rivet; and iv) moving the carrier belt to transport the converted end to a reform station, where the end is reformed by moving the center panel and the seaming flange one with respect to the other to raise the center panel above the level of the seaming flange.

4. The method according to claim 1, wherein reforming the can end comprises:

i) clamping the radially outer seaming flange of the end by means of a clamping ring; and ii) moving the clamping ring and a punch one with respect to the other so as to push the center panel upwardly to a position above the level of the seaming flange.

5. The method according to claim 4, wherein reforming the can end comprises moving the punch upwardly with respect to the clamping ring.

6. A method of manufacturing a can end comprising the steps of i) forming an end shell from an aluminum alloy material having a thickness of approximately 0.22 mm or less and a proof strength of approximately 250 N/mm$^2$ or less so that the end shell comprises a radially outer seaming flange, a chuck wall adjacent the seaming flange, a center panel, and an axially downward countersink joining the center panel to the chuck wall below the level of the seaming flange;

ii) converting the shell to an easy-open can end by:

a) forming a score on a portion of the center panel;

b) raising a rivet on the center panel; and c) forming a tab and attaching the tab to the rivet; and iii) subsequently forming the end by moving the center panel and the seaming flange one with respect to the other to raise the center panel above the level of the seaming flange.

7. The method according to claim 6, wherein forming an end shell from an aluminum alloy material having a thickness of approximately 0.22 mm or less and a proof strength of approximately 250 N/mm$^2$ or less comprises forming an end shell from an aluminum alloy material having a proof strength of approximately 225 N/mm$^2$ or less.

8. The method according to claim 7, wherein forming an end shell from an aluminum alloy material having a thickness of approximately 0.22 mm or less and a proof strength of approximately 250 N/mm$^2$ or less comprises forming an end shell from an aluminum alloy material having a proof strength within a range of approximately 190 N/mm$^2$ to approximately 220 N/mm$^2$.

9. The method according to claim 6, wherein forming an end shell from an aluminum alloy material having a thickness of approximately 0.22 mm or less and a proof strength of approximately 250 N/mm$^2$ or less comprises forming the end shell from a 5000 series alloy.

10. The method according to claim 9, wherein forming an end shell from an aluminum alloy material having a thickness of approximately 0.22 mm or less and a proof strength of approximately 250 N/mm$^2$ or less comprises forming the end shell from a 5052 alloy.

11. The method according to claim 9, wherein forming an end shell from an aluminum alloy material having a thickness of approximately 0.22 mm or less and a proof strength of approximately 250 N/mm$^2$ or less comprises forming the end shell from one of a 5352 alloy, a 5042 alloy, a 5154 alloy, a 5182 alloy, and a 5082 alloy.

12. The method according to claim 6, wherein forming an end shell from an aluminum alloy material having a thickness of approximately 0.22 mm or less and a proof strength of approximately 250 N/mm$^2$ or less comprises forming the end shell from a 3000 series alloy.

13. The method according to claim 12, wherein forming an end shell from an aluminum alloy material having a thickness of approximately 0.22 mm or less and a proof strength of approximately 250 N/mm$^2$ or less comprises forming the end shell from one of a 3004 alloy, a 3104 alloy, and a 3105 alloy.

14. The method according to claim 6, wherein forming an end shell from an aluminum alloy material having a thickness of approximately 0.22 mm or less and a proof strength of approximately 250 N/mm$^2$ or less comprises forming the end shell from an 8000 series alloy.

15. The method according to claim 6, wherein forming an end shell from an aluminum alloy material having a thickness of approximately 0.22 mm or less and a proof strength of approximately 250 N/mm$^2$ or less comprises forming a stay-on-tab easy-open can end.

16. The method according to claim 6, further comprising securing the end to a can body which has been filled with product, and performing a second reforming operation on the can end to move the center panel and the seaming flange one with respect to the other to lower the center panel to a height below the level of the seaming flange, thereby reducing the headspace within the package.

17. The method of claim 1, wherein subsequently forming the end by moving the center panel and the seaming flange one with respect to the other to raise the center panel above the level of the seaming flange comprises moving the center panel and the seaming flange one with respect to the other to shorten a chuck wall of the end formed between the center panel and the seaming flange.

18. The method of claim 2, wherein subsequently forming the end by moving the center panel and the seaming flange one with respect to the other to raise the center panel above the level of the seaming flange comprises moving the center panel and the seaming flange one with respect to the other to shorten a chuck wall of the end formed between the center panel and the seaming flange.

19. The method of claim 3, wherein moving the carrier belt to transport the converted end to a reform station, where the end is reformed by moving the center panel and the seaming flange one with respect to the other to raise the center panel above the level of the seaming flange comprises moving the center panel and the seaming flange one with respect to the other to shorten a chuck wall of the end formed between the center panel and the seaming flange.

20. The method of claim 6, wherein subsequently forming the end by moving the center panel and the seaming flange one with respect to the other to raise the center panel above the level of the seaming flange comprises moving the center panel and the seaming flange one with respect to the other to shorten a chuck wall of the end formed between the center panel and the seaming flange.

* * * * *